US009541275B2

(12) United States Patent
Deshpande

(10) Patent No.: US 9,541,275 B2
(45) Date of Patent: Jan. 10, 2017

(54) APPARATUS AND METHOD FOR MANAGEMENT OF HEAT IN A LED MOUNTED LIGHTING FIXTURE

(71) Applicant: Shirish Devidas Deshpande, Pune (IN)

(72) Inventor: Shirish Devidas Deshpande, Pune (IN)

( * ) Notice: Subject to any disclaimer, the term of this patent is extended or adjusted under 35 U.S.C. 154(b) by 0 days.

(21) Appl. No.: 14/378,927

(22) PCT Filed: Feb. 18, 2013

(86) PCT No.: PCT/IN2013/000099

§ 371 (c)(1),
(2) Date: Aug. 14, 2014

(87) PCT Pub. No.: WO2013/121444

PCT Pub. Date: Aug. 22, 2013

(65) Prior Publication Data

US 2016/0018095 A1 Jan. 21, 2016

(30) Foreign Application Priority Data

Feb. 15, 2012 (IN) ..... 423/MUM/2012

(51) Int. Cl.

| | |
|---|---|
| ***F21V 29/00*** | (2015.01) |
| ***F21V 29/83*** | (2015.01) |
| *F21Y 101/02* | (2006.01) |
| *F21Y 105/00* | (2016.01) |

(52) U.S. Cl.
CPC ..... *F21V 29/83* (2015.01); *F21Y 2101/02* (2013.01); *F21Y 2105/001* (2013.01)

(58) Field of Classification Search
CPC ..... F21V 29/004; F21V 29/83
USPC ..... 362/373, 294
See application file for complete search history.

(56) References Cited

U.S. PATENT DOCUMENTS

| | | | | |
|---|---|---|---|---|
| 5,113,320 | A * | 5/1992 | Haydu | B60Q 1/045 362/294 |
| 5,172,973 | A * | 12/1992 | Spada | F21V 29/02 362/218 |
| 5,947,592 | A * | 9/1999 | Barlow | F21V 29/02 362/294 |
| 7,329,033 | B2 * | 2/2008 | Glovatsky | B60Q 1/0052 362/294 |
| 9,175,812 | B2 * | 11/2015 | Jung | F21K 9/13 |

(Continued)

FOREIGN PATENT DOCUMENTS

| | | |
|---|---|---|
| CN | 101451697 | 6/2009 |
| CN | 101701701 B | 5/2010 |

(Continued)

OTHER PUBLICATIONS

International Search Report for corresponding International Application No. PCT/IN2013/000099, date Jul. 25, 2013, 4 pages.

*Primary Examiner* — Bryon T Gyllstrom
(74) *Attorney, Agent, or Firm* — Ditthavong & Steiner, P.C.

(57) ABSTRACT

The invention provides an apparatus and a method to dissipate heat generated in a LED mounted lighting fixture, comprising an active heat sink with a plurality of integral vents into such active heat sink, wherein the plurality of vents have only two openings, a first opening and a second opening, wherein the active sink is characterized by an induced local air convection current, induced by heat generated at a LED junction in the LED mounted lighting fixture.

8 Claims, 5 Drawing Sheets

(56) References Cited

U.S. PATENT DOCUMENTS

| | | | | |
|---|---|---|---|---|
| 2006/0181894 | A1* | 8/2006 | Chinniah | F21S 48/115 362/547 |
| 2006/0193139 | A1* | 8/2006 | Sun | F21V 29/006 362/373 |
| 2006/0232973 | A1* | 10/2006 | Haga | F21V 29/02 362/264 |
| 2008/0212333 | A1* | 9/2008 | Chen | F21V 29/02 362/373 |
| 2008/0285265 | A1* | 11/2008 | Boissevain | F21S 8/086 362/218 |
| 2009/0067182 | A1* | 3/2009 | Hsu | F21S 6/003 362/373 |
| 2009/0196063 | A1* | 8/2009 | Kracker | B60Q 1/0017 362/547 |
| 2010/0242519 | A1* | 9/2010 | Breidenassel | F21V 29/004 62/264 |
| 2016/0123571 | A1* | 5/2016 | Chan | F21V 29/83 362/249.01 |
| 2016/0186982 | A1* | 6/2016 | Xiong | F21V 29/83 362/234 |

FOREIGN PATENT DOCUMENTS

| | | | |
|---|---|---|---|
| CN | 101956921 | A | 1/2011 |
| CN | 102003693 | A | 4/2011 |
| WO | 2007/036958 | A1 | 4/2007 |

* cited by examiner

APPARATUS AND METHOD FOR MANAGEMENT OF HEAT IN A LED MOUNTED LIGHTING FIXTURE

CROSS REFERENCE TO RELATED APPLICATIONS

This application is a national phase application of PCT Application No. PCT/IN2013/000099, filed Feb. 18, 2013, and claims priority of Indian Application No. 423/MUM/2012, filed Feb. 15, 2012, the content of both of which are incorporated herein by reference in their entireties.

FIELD OF THE INVENTION

The present invention relates to heat management, more particularly the present invention relates to an apparatus and a method for managing the heat generated in a LED mounted lighting fixture.

BACKGROUND OF THE INVENTION

Light emitting diodes or solid-state lighting are replacing incandescent bulbs, compact fluorescent lamp (CFL), High Pressure Sodium Vapor Lamp, Metal Halide Lamp and Halogens as a source of illumination for various indoor and outdoor applications worldwide. According to a study, by U.S. Department of Energy published in Pittsburgh LED Street Light Research Project, use of LED (light-emitting diodes) lighting can reduce energy consumption by one-quarter, saving $120 billion in energy costs and diverting 246 million metric tons of carbon emissions in US alone.

However, management of the performance and life of LEDs is the major hurdle for successful and economical implementation of LED/SSL based lighting fixtures. Life and performance of any LED/SSL based device is critically associated with the heat generated during the operation of the LED. According to a study published in Pittsburgh LED Street Light Research Project it is estimated that about 70% to 80% of power consumed is converted to heat and only 20% to 30% is converted to visible light. Another paper published by authors N. Naredranet. al., having title"Long-term performance of White LED's and systems" discloses that the drive current and the ambient temperature surrounding the LED also affect the performance of LED device. Thus, making the use of the LED lighting systems, more apt for colder regions where the ambient temperature of the surrounding is lower, helping LED to perform better and have a higher rated life.

Moreover, the performance of LED lighting systems is affected by high operating temperatures. The high operating temperature degrades the performance of the LED lighting systems and also hampers the rated life. Empirical data has shown that LED lighting systems may have lifetimes up to50,000 hours while at room temperature; however, operation at close to 90 degree Celsius may reduce the LED life to less than 7,000 hours. Thus, effective management of the heat generated by the LEDs is critical technical problem.

Another factor affecting the successful and commercial implementation of the LEDs is the cost of the LED based lighting systems. The cost for LED based lighting system has two major components, the cost of LEDs, and the cost of material used as Heat Sink. With the pace at which the research is being made on LEDs and their manufacturing process, it is evident that the manufacturing cost for LEDs would reduce drastically over the time. Thereby, the quantum of metal used as heat sink would govern the affordability for a LED/SSL based lighting system. The amount of material used (especially cost of metal) shall dominate the cost of entire lighting apparatus.

Thus, the effective dissipation of heat for per gram of metal used to prepare a lighting fixture remains a long felt need of the society.

One of the prior art known to us that addresses the problem related to heat management in LED based lighting apparatus is discussed below:

US 2008007953 application filed by Keller Berndet. al. discusses the issue of heat management for solid-state lighting to improve the life and performance. The disclosure teaches the use of heat sink having at least partially porous structure. Keller Bernd et. al. further teaches that the pores in the material should interconnect with each other to facilitate an effective convective heat exchange with the ambient air.

OBJECTS OF THE INVENTION

The principal object of the present invention is to provide an apparatus and method for utilizing waste heat generated in a LED mounted lighting fixture to generate a natural air convection current for heat dissipation.

Another object of the invention is to provide a plurality of integral vents placed at an angle to ground, wherein each of the plurality of vents has only two openings at opposite ends.

Yet another object of the present invention is to provide an apparatus enabling the use of higher drive current or more watt power compared to the conventional LED system for proportional amount of heat sink material by weight.

SUMMARY OF THE INVENTION

Before the present methods, apparatuses, and components are described, it is to be understood that this invention in not limited to the particular designs, and methodologies described to manufacture active heat sink and lighting fixtures, as there can be multiple possible embodiments of the present invention which are not expressly illustrated in the present disclosure. It is also to be understood that the terminology used in the description is for the purpose of describing the particular versions or embodiments only, and is not intended to limit the scope of the present invention.

An apparatus and a method is disclosed in the present invention for a LED lighting fixture wherein an active heat sink is utilized to dissipate heat generated at a LED junction. The active heat sink further comprises a plurality of integral vents placed at an angle to ground. The plurality of integral vents may be defined as vents integrated or in built in to the heat sink. The placement of the plurality of vent at an angle to the ground enables local air convection current to flow. The local air convection current is induced by the virtue of the heat generated at the LED junction. Each of the plurality of vents has only two openings at opposite ends, a first opening and a second opening. The first opening is at lower height with reference to the second opening.

Once the local air convection current is set, the lighting fixture cools efficiently compared to a conventional LED system having a passive heat sink. The heat sink of the present invention acts as an active heat sink since it induces the local air convection current. The reduction of heat sink temperature in turn translates to reduction of a junction temperature of the LED by a factor greater than 1, there by improving the life of the LED.

BRIEF DESCRIPTION OF DRAWINGS

The foregoing summary, as well as the following detailed description of preferred embodiments, is better understood when read in conjunction with the appended drawings. For the purpose of illustrating the invention, there is shown in the drawings example constructions of the invention; however, the invention is not limited to the specific designs and sizes of the LED mounted lighting fixture and active heat sinks disclosed in the drawings.

DESCRIPTION OF THE INVENTION

Figure 1:
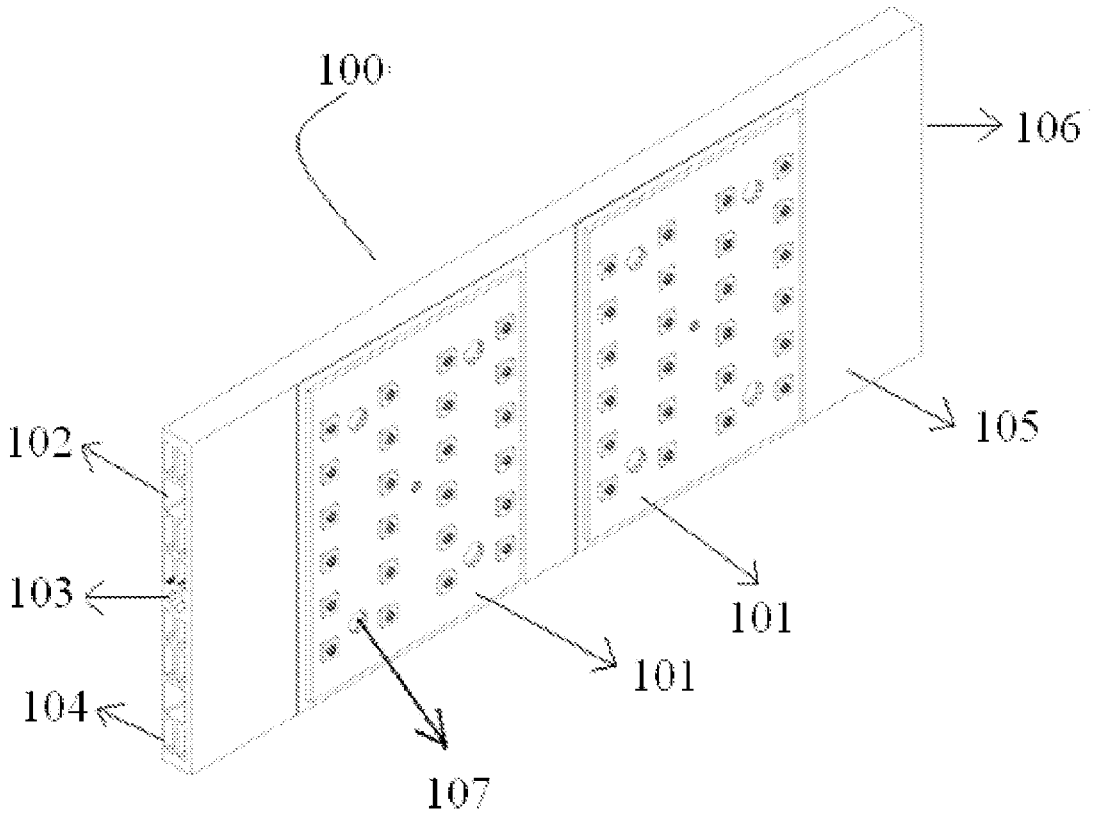
FIG. 1 shows an isometric view of an LED based lighting fixture according to an embodiment of the present invention.

Some embodiments of this invention, illustrating its features, will now be discussed:

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems, methods, apparatuses, and devices similar or equivalent to those described herein can be used in the practice or testing of embodiments of the present invention, the preferred, systems and parts are now described.

The disclosed embodiments are merely exemplary of the invention, which may be embodied in various forms.

The technical challenges that may be incurred in using light emitting diode (LED) based lighting system are:

1. Management of the heat generated by the LED chip, as the heat drastically affects the efficiency, performance, and life of LED chip.
2. Amount of material used as heat sink in order to dissipate heat generated per watt of LED.
3. Heat sinks used for outdoor and indoor LED based lighting systems act as a passive component unless an external gadget is used for forced cooling which may require external energy source.

To overcome the above listed drawbacks, the present invention discloses an apparatus and a method having an active heat sink. The active heat sink efficiently reduces temperature at the LED junction, thereby improving the life of the LED. An active heat sink is general is defined as a heat sink wherein the heat generated by an apparatus is dissipated by using an air convection current generated by external components like fan.

According to an embodiment of the present disclosure, an apparatus and a method for improving heat dissipation has been disclosed wherein a heat sink may be used to improve the heat dissipation in order to reduce junction temperature of the LED. The heat sink may be an active heat sink, wherein the heat sink sets-up local air convection current naturally, i.e. setting up of local air current without using an external source such has a cooling fan. The heat sink may comprise of a plurality of integral vents that are emended in lighting fixture, wherein each vent has only two openings. The use of the plurality of integral air vents in the lighting fixture can increase the surface area available for heat dissipation without increasing the weight of the heat sink. The two openings of the vents are such that cold air enters a first opening positioned at a lower side with reference to a second opening. The use of plurality of integral air vents in the lighting fixture can setup a current of local air convection even when the surrounding air is still. The local air convection current can reduce the LED junction temperature efficiently by way of carrying the heat away from the source by conduction and radiation and further by means of air convection.

In LED conventional lighting fixture, the heat generated is dissipated as waste heat. In the present invention, the heat generated by the lighting fixture as waste heat, is used as an energy source to set-up a local air convection current without the use of external components like fan. The setting up of the local air convection current makes the present heat sink an active heat sink. The local air convection current facilitates efficient heat transfer from the heat sink to induced air. The heat sink with induced air in turn reduces LED junction temperature, wherein the LED junction temperature may be reduced by three ways: a) conduction where the heat sink material is in contact with lighting fixture, b) radiation from the heat sink to the air surrounding the lighting fixture and most importantly c) convection when transferred from the heat sink to air convection current. The reduction of the LED junction temperature is critical because it has been observed, that the life of the LED is inversely proportional to the junction temperature; In a scenario for Roadstar™ when the temperature of a heat sink is 85 degree Celsius, the temperature at the junction would be 112 degree Celsius, the expected life would be 70000 hours and in another scenario where the temperature of heat sink is 65 degree Celsius the junction temperature would be 82 degree Celsius, the expected life would be higher than 70000 hours.

The active heat sink of the present invention can be manufactured by extrusion method, pressure die casting method or sheet metal forming operation or ceramic molding. The method for manufacturing is selected on basis on strength required and intricacy of the profile to be manufactured. Use of these processes for manufacturing active heat sink reduces the metal wastage and also helps in producing the desired job profile without increasing the material or metal required.

The active heat sink according the present invention may dissipate heat received by conduction in two ways, radiation and convection. The active heat sink of the present invention is characterized by generation of local air convection current naturally, that is without the use of external components like fan, thus making the system efficient, cost-effective, and eco-friendly. As the plurality of integral vents effectively manage the heat dissipation due to the increased surface area and air flow, thereby allowing for reduction in size of the heat sink as compared to identical scenario where conventional heat sink is used.

In an embodiment of the present disclosure the material used for manufacturing the heat sink having integral plurality of vents can be selected from a group consisting of aluminum, copper, ceramics, alloys and combination thereof.

FIG. 1 illustrates an isometric view of an LED based lighting fixture (100) according to an embodiment of the present disclosure in accordance to an embodiment of the present disclosure wherein the lighting fixture (100) comprises a heat sink (106) wherein a plurality of light emitting diode cassette (101) are mounted on a metal-core printed circuit board (MCPCB) (Not shown). In an embodiment the combination of plurality of LED cassette (101) and MCPCB is mounted on the lighting fixture (106) using at least one bolt (not shown here). The at least one bolt is positioned such that they coincide with at least one hole (107) on a first surface (105). The at least one hole (107) when observed from at least one end (Not shown here) is represented by (102), wherein the hole (102)is a through hole parallel to the first surface (105). A first hole (103) observed from the at least one end is a through hole running parallel to the first surface (105). The heat sink (106) further comprises a plurality of vents (104) integral with the heat sink (106), integrating the vents into the heat sink (106), enables the lighting fixture (100) to be light in weight.

The plurality of vents (104) may have a profile representing a honeycomb, a square, or any geometric shape and combination thereof when viewed in a two-dimension. Further the plurality of vents (104) can be parallel to the first surface (105) or at angle, wherein the plurality of vents (104) can further have a varying cross-section. Air can enter the plurality of vents (104) through a first opening (Not Shown) and exit from a second opening (Not Shown), enabling reduction in the working temperature of the lighting fixture (100) by bringing the temperature in the range of the surrounding ambient temperature. According to an embodiment the first opening and second opening for each of plurality of vents (104) may have the same profile or the profile may vary over a length of the plurality of vents (104) or at the ends only, the variation of the profile may give rise to a turbulent air flow.

Figure 2:
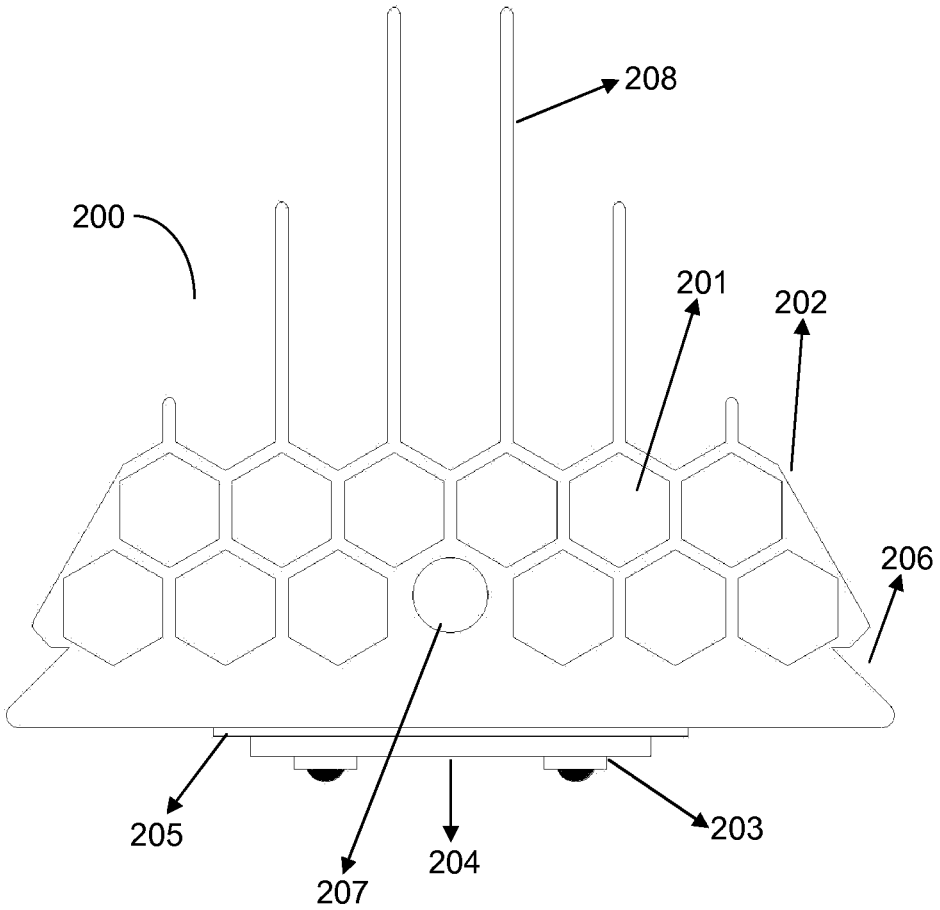
FIG. 2 shows a cross-sectional view of an LED based lighting fixture according to an embodiment of the present invention.

FIG. 2, shows a cross-sectional view of an LED based lighting fixture according to an embodiment of the present disclosure wherein the lighting fixture (200) comprises a heat sink (202) having integral vents (201) or channels extruded in a honeycomb like profile. The honeycomb like profile provides torsional rigidity to the lighting fixture (200). The integral vents (201) may setup a local air current for dissipation when the lighting fixture (200) reaches a threshold. The lighting fixture (200) further comprises a slidable section (206) enabling the system to be a modular system. A through hole (207) perpendicular to a LED cassette mounted to the heat sink (202) is configured to be a retrofit-able for existing lighting structures (Not shown here). The LED cassette (203) is mounted on a metal core printed circuit board (MCPCB) (204). The MCPCB (204) and heat sink (202) are connected through a thermal interface 205). The lighting fixture (200) according to an embodiment may comprises of a plurality of extended fins (208), wherein the plurality of extended fins (208) further help in efficient cooling by providing extended area for conduction and radiation of heat. The plurality of extended fins (208) helps reduce the junction temperature of the LED enabling extended life for the LED.

Figure 3:
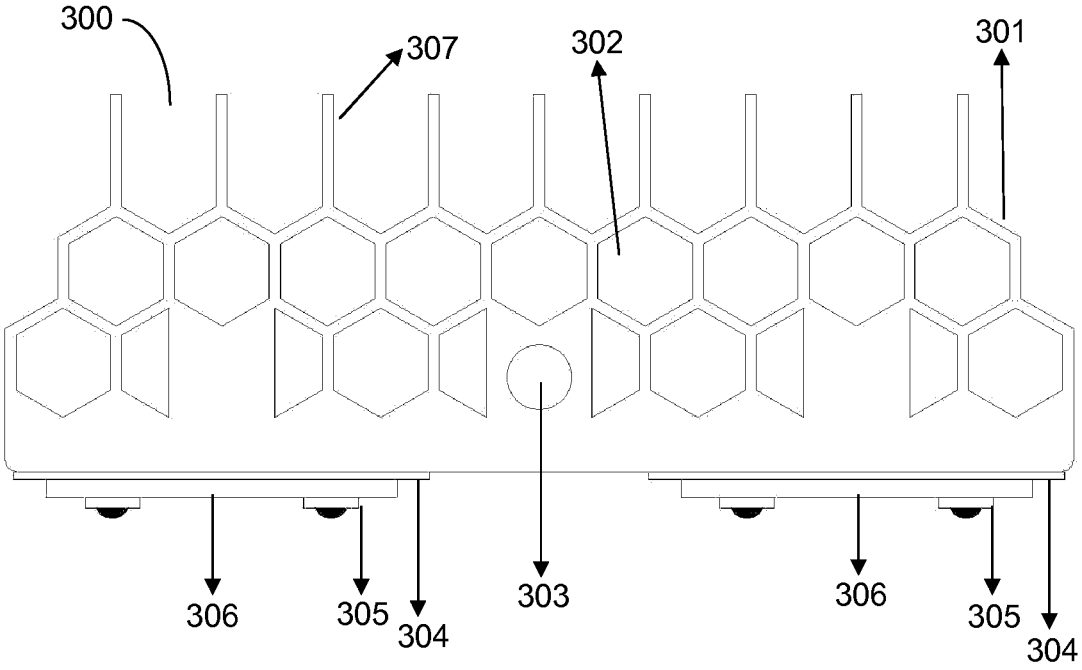
FIG. 3 illustrates across-sectional view of an LED based lighting fixture according to an embodiment of the present invention.

FIG. 3, illustrates a cross-sectional view of an LED based lighting fixture according to an embodiment wherein a lighting fixture (300) comprises of a heat sink (301) having a corrugated surface for heat dissipation. A corrugated surface for heat dissipation increases the surface area available for cooling. Since the heat sink (301) acts as a primary heat sink the corrugation improves heat conduction capacity. Further the heat sink (301) acting as the primary heat sink has a plurality of integral vents (302) running along the length of the lighting fixture (300) and perpendicular to a plurality LED (305). The plurality of integral vents (302) having a honeycomb like structure can be manufactured by extrusion process. The plurality of integral vents (302) helps in setting up local air convection when the temperature in the heat sink reaches the threshold. A through hole (303) running parallel to the plurality of integral vents (302) enable the lighting fixture (300) to be retro fitted on the existing light mounting apparatuses (Not Shown). The through hole (303) also provides modularity to the lighting fixture (300). The plurality of LED (305) are embedded on a metal core printed circuit board (MCPCB)(306), which in turn are connected to the heat sink (301) through a thermal interface (304). The lighting fixture (300) may further comprise a plurality of fins (307) extending from the heat sink (301) having a corrugated surface for heat conduction and radiation.

Figure 4:
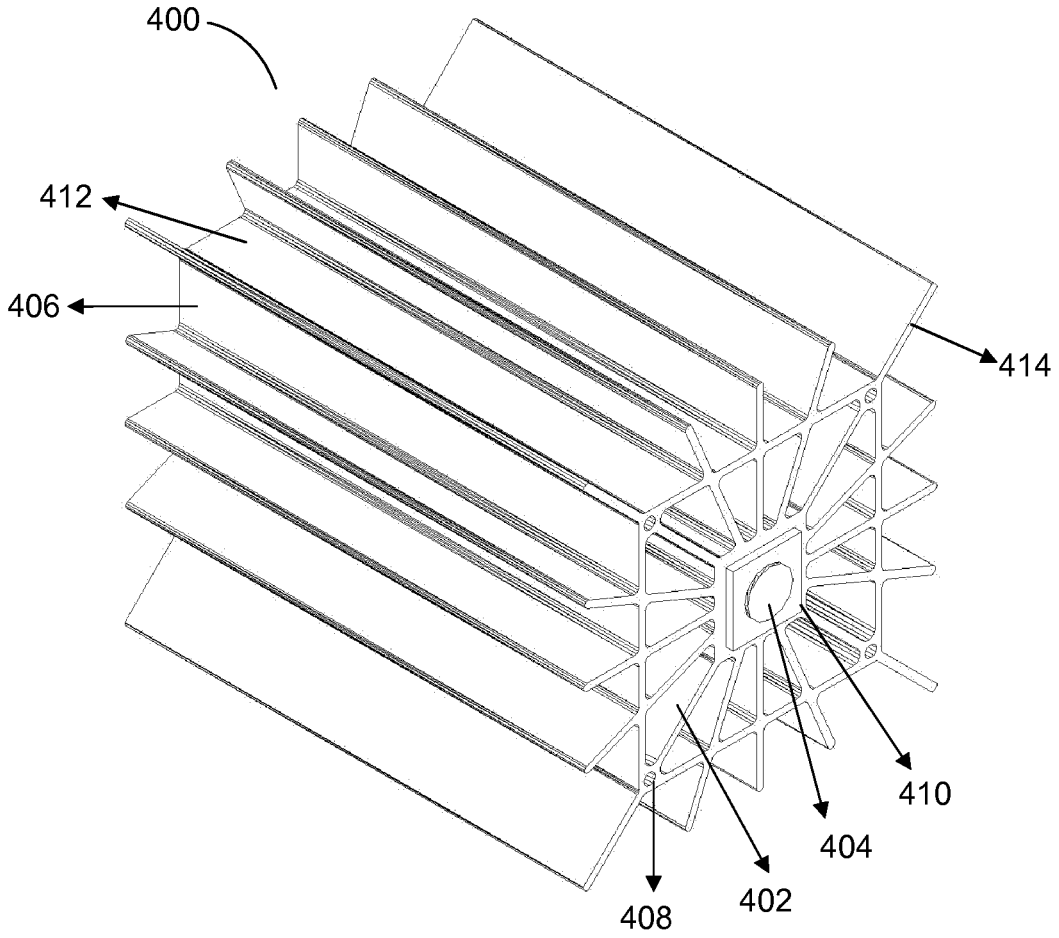
FIG. 4 illustrates of an LED based lighting fixture according to an embodiment of the present invention.

Referring to FIG. 4, illustrates a LED based lighting fixture according to an embodiment of the present disclosure. The lighting fixture (400) comprises a heat sink (406) having at least one first hole (408), wherein the first hole enables the lighting fixture (400) to be mounted on a structure. The heat sink (406) is an active heat sink comprising a plurality of vents (402) formed integrally. According to an embodiment of the disclosure the plurality of vents (402) are formed in a first direction perpendicular to axis of a metal-core printed circuit board (MCPCB) (410), wherein at least one LED (404) is mounted on the MCPCB (410). The axis of the MCPCB can be defined as the axis parallel to a surface (412). The present embodiment of the lighting fixture (400) may be mounted in a perpendicular direction. The plurality of vents (402) may provide an effective cooling for each LED in a LED cassette and the at the LED junction. The lighting fixture (400) may further comprise a plurality of extended fins (414) according to an embodiment.

Figure 5:
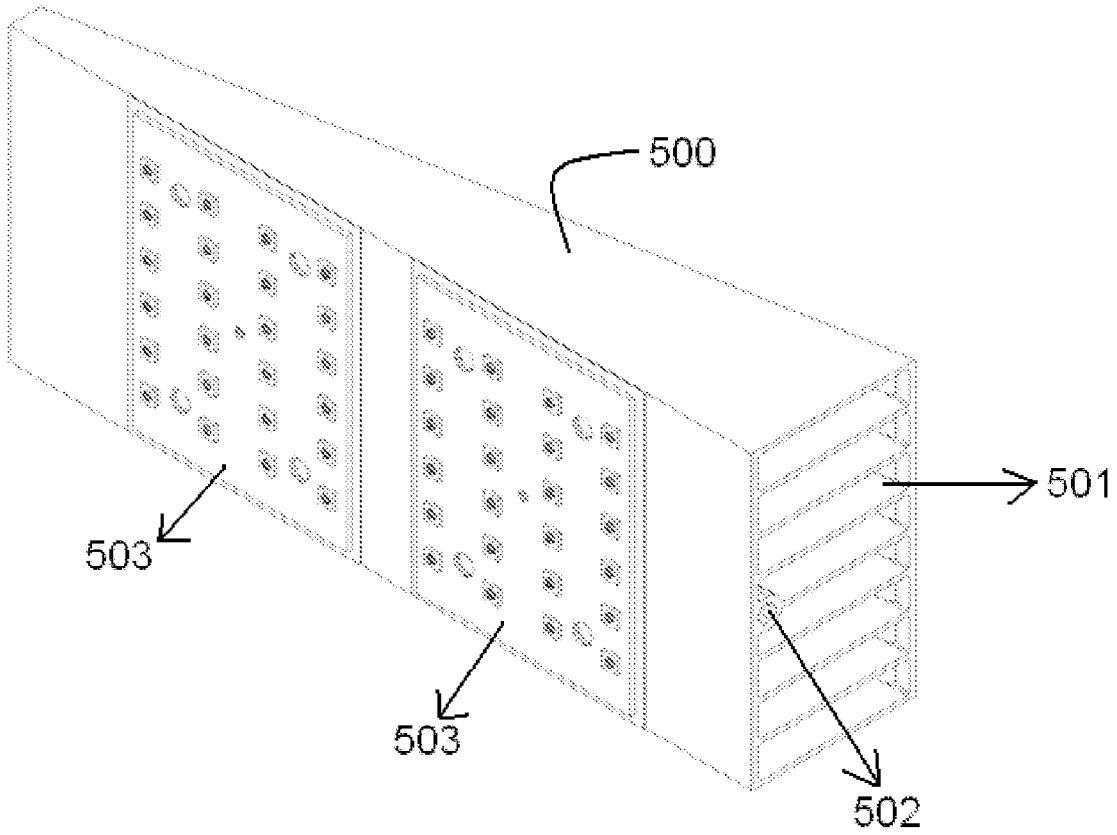
FIG. 5 shows an isometric view of an LED based lighting fixture according to an embodiment of the present invention.

FIG. 5, shows an isometric view of an LED based lighting fixture according to an embodiment of the present disclosure. The lighting fixture (500) comprising a plurality of light emitting diodes (503) mounted on the lighting fixture (500), wherein the lighting fixture (500) has a plurality of vents (501). The plurality of vents (501) has a varying cross-section over the length of a heat sink. The first hole (502) helps mount the lighting fixture (500) on existing infra structure without any need to make substantive change.

WORKING EXAMPLE

The present invention may be illustrated by way of experimentation as follows: A lighting fixture having 10 high power LEDs is used. The LEDs are energized by 640 mA current, wherein the heat sink used for heat dissipation has a weight of 420 gm. The heat sink is a natural anodized Aluminum, wherein the same lighting fixture is used for compiling readings from two scenarios; first for a heat sink without vents and second for a heat sink with vents. The heat sink in both the scenario is mounted at an angle of 20 degree to the ground. Upon initiating the experiment for the two scenarios it was observed that the temperature difference between the heat sink without vent and heat sink with vents was around 10 degree Celsius.

The heat sink in both scenarios was at an ambient temperature of 28 degree Celsius. Following table illustrates the reading compiled for the experiment in two scenarios:

| Starting time - | Heat Sink | |
|---|---|---|
| 11.00 am Time | Without Vents Temperature ° C. | With Vents Temperature ° C. |
| 11.20 am | 56 | 49 |
| 11.40 am | 61.5 | 51 |

-continued

| Starting time - | Heat Sink | |
|---|---|---|
| 11.00 am Time | Without Vents Temperature ° C. | With Vents Temperature ° C. |
| 12.00 pm | 62 | 52 |
| 12.20 pm | 62 | 52.5 |
| 12.40 pm | 63 | 52.5 |
| 1.00 pm | 63 | 52.5 |
| 1.20 pm | 63 | 52.5 |

From the above table we may infer that the heat sink with vents is at lower temperature by about 10 degree Celsius compared to heat sink without vents, proportionally the temperature difference at the real LED junction would be more than 10 degree Celsius. The reduction in temperature at the LED junction enables us to design a heat sink having reduced weight, which makes economic sense in large scale production.

ADVANTAGES OF THE INVENTION

The present invention offers following advantages over the conventional LED apparatus and systems:

1. The system enables increased surface area for management of heat generated by the LEDs.
2. The system enables increased surface area for management of heat generated by the LEDs without increasing the amount of material needed to manufacture heat sink.
3. The system enables setting up of air convection current flow without the assistance from external sources such as fan.
4. The apparatus enables to drive the lighting fixture at higher current without affecting the life and performance of LED.

I claim:

1. A Light Emitting Diode (LED) mounted lighting fixture, comprising:

an LED; and a heat sink for dissipating heat generated by the LED, wherein the LED is mounted on the heat sink, wherein the heat sink comprises a plurality of integral vents each having a cross section, wherein the cross section of each of the plurality of integral vents varies across an entire length of the integral vent such that a top side of longer sides of the heat sink has an oblique angle to a plane parallel to a bottom side of the longer sides, and wherein each of the plurality of integral vents comprises a first opening and a second opening at opposite sides such that a local air convection current throughout the integral vents is induced from the first opening towards the second opening by virtue of the heat generated by the LED.

2. The LED mounted lighting fixture of claim 1, wherein the plurality of vents further comprises of a cross-section, and wherein the cross-section is selected from:

a cross-section constant over a length of the heat sink; or a uniformly varying cross-section over the length of the heat sink.

3. The LED mounted lighting fixture of claim 1, wherein the cross-section has a geometric profile selected from a circle, a hexagonal, a square, a triangular or a combination thereof.

4. The LED mounted lighting fixture of claim 3, wherein the geometric profile for the cross-section is constant over the length of the heat sink.

5. The LED mounted lighting fixture of claim 1, wherein a higher drive current or a more watt power is achieved compared to a conventional LED system for a proportional amount of heat sink material by weight.

6. The LED mounted lighting fixture of claim 1, wherein a temperature of the heat sink while the LED mounted lighting fixture is in operation is reduced by at least 10 degrees Celsius.

7. The LED mounted lighting fixture of claim 6, wherein a temperature of an LED junction while the LED mounted lighting fixture is in operation is reduced by a factor >1 as compared to the temperature of the heat sink.

8. A method to dissipate heat generated in a Light Emitting Diode (LED) mounted lighting fixture, method comprising:

forming a plurality of vents in the active heat sink such that the plurality of vents are integral to the active heat sink, wherein each of the plurality of vents has a varying cross section across an entire length of the vent such that a top side of longer sides of the heat sink has an oblique angle to a plane parallel to a bottom side of the longer sides;

inducing a local air convection current in the plurality of vents by operating at least one LED to enable a temperature rise at an LED junction associated with the at least one LED, wherein the local air convection current is induced by the temperature rise at the LED junction; and dissipating heat generated by the rise in the temperature at the LED junction by conduction, radiation, convection, or a combination thereof.

* * * * *